United States Patent [19]

Beatty

[11] 4,136,592

[45] Jan. 30, 1979

[54] APPARATUS FOR ONE-PASS PUNCHING OF BEAMS

[75] Inventor: William C. Beatty, Munster, Ind.

[73] Assignee: Beatty Machine & Manufacturing Co., Hammond, Ind.

[21] Appl. No.: 691,343

[22] Filed: Jun. 1, 1976

[51] Int. Cl.[2] ..... B26F 1/14; B26D 5/04

[52] U.S. Cl. ..... 83/516; 83/560; 83/573; 83/639; 83/685; 408/46

[58] Field of Search ..... 83/618, 631, 639, 640, 83/685, 687, 516, 560, 573, 539; 408/46

[56] References Cited

U.S. PATENT DOCUMENTS

| | | | |
|---|---|---|---|
| 746,800 | 12/1903 | Doolittle | 83/618 |
| 1,164,027 | 12/1915 | Stevenson | 83/618 X |
| 1,202,175 | 10/1916 | Foote | 83/573 X |
| 1,553,378 | 9/1925 | Harper | 83/618 X |
| 3,667,333 | 6/1972 | Flynn, Jr. | 83/560 X |
| 3,749,507 | 7/1973 | Haley | 408/46 |
| 3,892,154 | 7/1975 | Duffy | 83/639 X |
| 4,040,320 | 8/1977 | Cloup | 83/560 X |

FOREIGN PATENT DOCUMENTS

| | | | |
|---|---|---|---|
| 19977 of | 1894 | United Kingdom | 408/46 |

*Primary Examiner*—Willie G. Abercrombie
*Attorney, Agent, or Firm*—Louis Robertson

[57] ABSTRACT

During passage of an I-beam through a punching press for punching holes vertically through its web, holes are also punched through its flanges by horizontally acting punches of the present invention. Four C-shaped punching heads are provided for the flanges. To permit punching closely adjacent holes, two punches are powered by a single hydraulic cylinder, unless one is deactivated. A joint gauge screw precisely adjusts gauge (the spacing between the two punches), and may be raised or lowered for centering as to web. Before each flange punching operation, the web is pressed firmly against a fixed block level with the web die. The piston of the hydraulic cylinder is of such large diameter that the varying positions of the punches will lie within the projected periphery of the piston rod.

4 Claims, 6 Drawing Figures

117
116
49
47
31
46
53
4
59
61
58
62
56
68
54
94
91
47
49
119

102
49
48
26
107
106
82
81
31
46
91
92
94
47
109
108
67
58
34
57
64
66
63
69
53
68
78
76
77
79
49
48
52
32
71
56
59
51
5
68
51
32
48
49
63
93
94
67
31
46
26
48
118

APPARATUS FOR ONE-PASS PUNCHING OF BEAMS

INTRODUCTION

The invention of which the present disclosure is offered for public dissemination in the event adequate patent protection is available relates to the punching of structural steel members such as I-beams, and particularly to the accurate and convenient punching of holes through the flanges of such beams during a single pass in which the web is also punched.

In the past, most beam punching was done by two or three passes of the beam through a vertically-acting punch press. There would be one pass for punching the web and another pass for each flange to be punched, the beam being turned about its longitudinal axis between successive passes to position the surface to be punched in an upwardly facing posture. Some horizontally acting flange punches have been developed or proposed. For example, the owner of the present invention long ago developed a pair of horizontally acting punches which, with some sizes of beams, could punch the flanges of beams without their being turned over from the web-punching position. However, the manner of obtaining the necessary height positioning of the beam for this flange-punching operation was not suitable for general use in single-pass use in connection with a web punch. There has been some single-pass punching, using (with some difficulties and limitations) various individual C-clamp punches of relatively portable nature. U.S. Pat. No. 3,892,154, although not prior to the present development, contemplates horizontal punching of the flanges by more installed punches, in the same pass of the beam during which the web is punched. However, there is reason to doubt that it would attain sufficient accuracy; and in using one cylinder for a pair of punches it may have failed to be sufficiently free from trouble due to off-center forces.

According to the present invention, thoroughly satisfactory one-pass punching of both webs and flanges of beams can be achieved. Dependable gauge accuracy is achieved by a gauge adjustment screw which moves the two punch heads to provide exactly the desired spacing apart of these punches. Centering of the two punch center lines equally from the web is achieved by adjusting the vertical positioning of the gauge-adjusted pair of punching heads according to the thickness of the web, and pressing the web down in contact with a fixed positioning block. The face of the positioning block is at the same level as the working die-surface of the web punch, so that pressing onto the positioning block is compatible with web punching during the same pass. Close gauge spacing of the two heads is made possible by powering them with a single cylinder and piston. The off-center forces which result from this are made tolerable by using a piston of very large diameter such that the punches always lie within the piston periphery, projected.

The advantages of the invention will be more apparent from the following description and from the drawings.

DESIGNATION OF FIGURES

CONVENTIONAL BEAM PUNCHING

Figure 1:
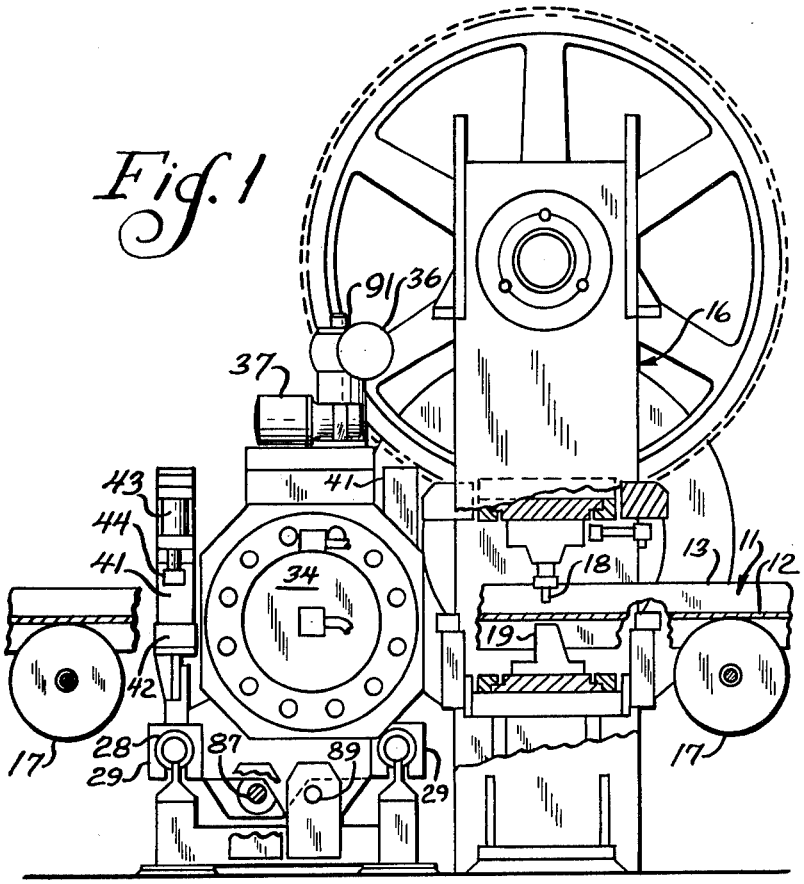
FIG. 1 is a side view, broken away to show some parts in section, of the combined apparatus including both web punch and flange punches, with a portion of the spacing table along which the beam being punched moves for its single passage through the combined press.

This invention is concerned with the punching of structural steel beams, an I-beam 11 having been chosen for illustration and discussion. The I shape of the beam 11 is seen best in FIG. 3. It includes a web 12 connecting flanges 13 and 14.

According to practice long conventional, beams such as I-beam 11 were punched by a succession of passes through a huge punch press 16. During one pass, the beam would be positioned as shown with its web horizontal. During another pass of the beam 11 through the press 16, it would be positioned with its flange 13 uppermost, and during a third run it would be positioned with its flange 14 uppermost. It was moved longitudinally along the rollers 17 of a spacing table for spacing the beam 11 precisely with respect to the punch 18 and die 19, so that the holes will be punched in precisely predetermined positions. Besides accurate spacing of the beam 11 longitudinally, it was necessary and conventional to ensure accurate positioning of the beam being punched, in transverse directions, against the die 19 and against a lateral positioning block. These details, being conventional, need not be described.

GENERAL DESCRIPTION OF PRESENT INVENTION

Figure 3:
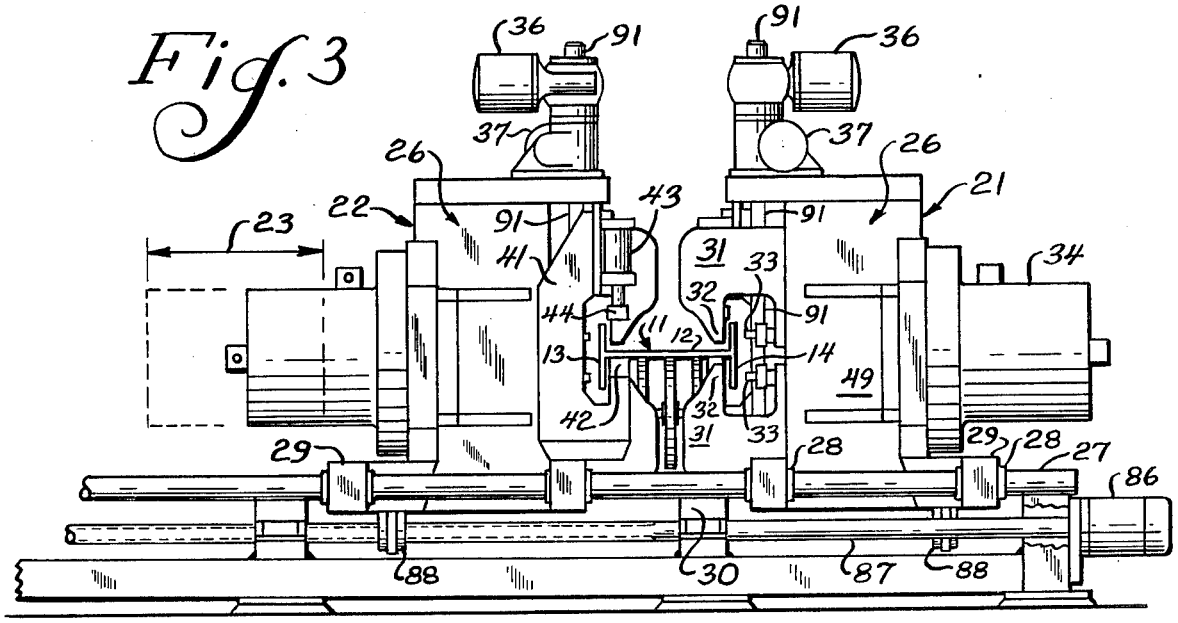
FIG. 3 is a view looking lengthwise of the beam, showing the relationship of the two flange presses to the beam.

According to the present invention the beam 11 makes a single pass through the punching apparatus, with its web 12 in horizontal position as illustrated. In addition to passing through the press 16 for web punching, it passes through the flange punching apparatus, the two main units of which are identical flange presses 21 and 22. Preferably both presses are shiftable to the right and left as seen in FIG. 3. Extensive movement of flange press 22 is indicated by the double arrow 23.

Because presses 21 and 22 are identical, both will be described in connection with press 21. Press 21 includes an upstanding frame 26 supported by a pair of rugged slide bars 27 through a spaced pair of friction-reducing bushings 28 mounted in feet 29 of the frame. Preferably the bushings 28 are of the type known as "Thompson ball bushings", but are of generally C-cross section so as to pass over supports 30 for rods 27. Enough such supports are provided to prevent any material flexing of the rods 27.

The frame 26 carries at its front side, facing the beam 11, a pair of punch assemblies 31 which are vertically slidable in the frame 26. Each punch assembly includes a C-shaped block 46 having a die tip 32, and a punch 33 for cooperating with the die 32. Both of the punches 33 are powered by the same hydraulic cylinder 34. A gauge-adjustment motor 36 (or gear-motor) adjusts the spacing of the beam assemblies 31 from one another. Independently of that adjustment, a drive 37 can make small adjustments in the height of the pair of assemblies 31 considered jointly, to equalize their spacing from the center of the web thickness.

Figure 2:
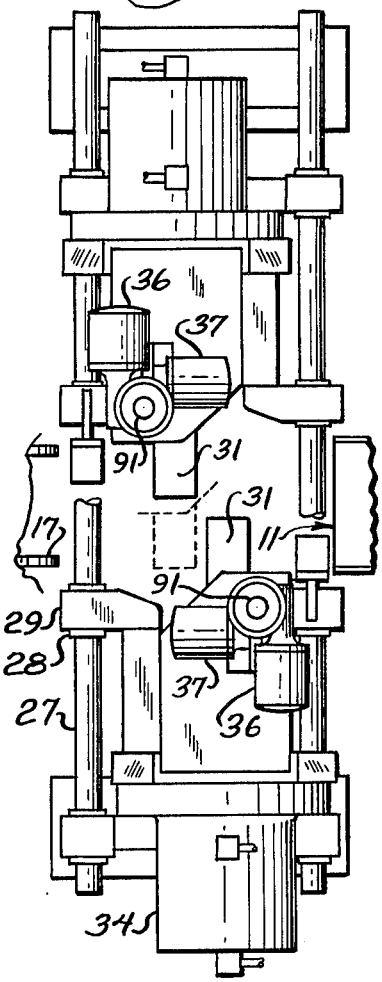
FIG. 2 is a view looking down on the flange presses, some parts being omitted. A leading beam-end is shown about to enter these presses from the right; the broken lines indicating adjustability of one of the flange punches for different widths of webs.

It is not expected that the presses 21 and 22 will ordinarily act simultaneously. To receive narrow-web beams, they must be offset (as seen in FIG. 2) and are not likely to be correctly positioned longitudinally of the beam simultaneously.

Each of the flange presses 21 and 22 also carries a positioning press which in this instance is most conveniently described with reference to the press 22. Thus a C-shaped yoke 41 is carried by the frame 26 and supports a positioning block 42 under the web 12 adjacent to the flange (13, in this case) which the associated press 22 is to punch. The yoke 41 also carries a double-acting cylinder 43 for actuating a plunger 44 to press the web 12 against the positioning block 42.

FLANGE PUNCH DETAILS

Figure 5:
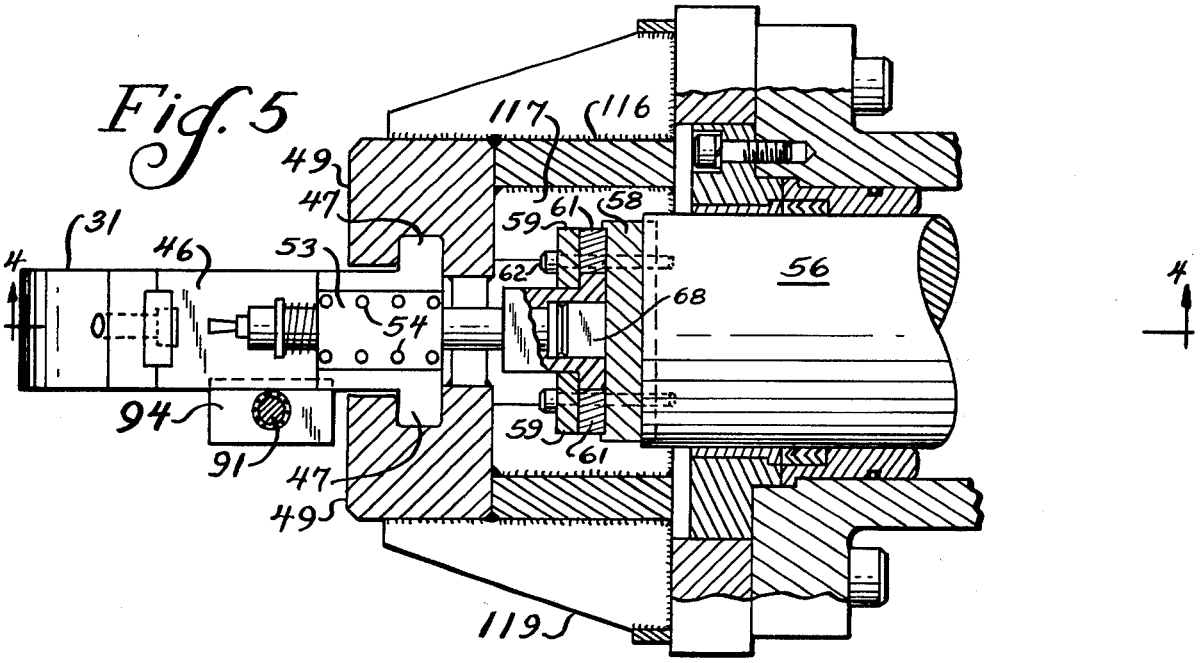
FIG. 5 is a view partly in horizontal section taken approximately along the line 5—5 of FIG. 4, and hence looking downwardly on the top of the lower punching head.
Figure 4:
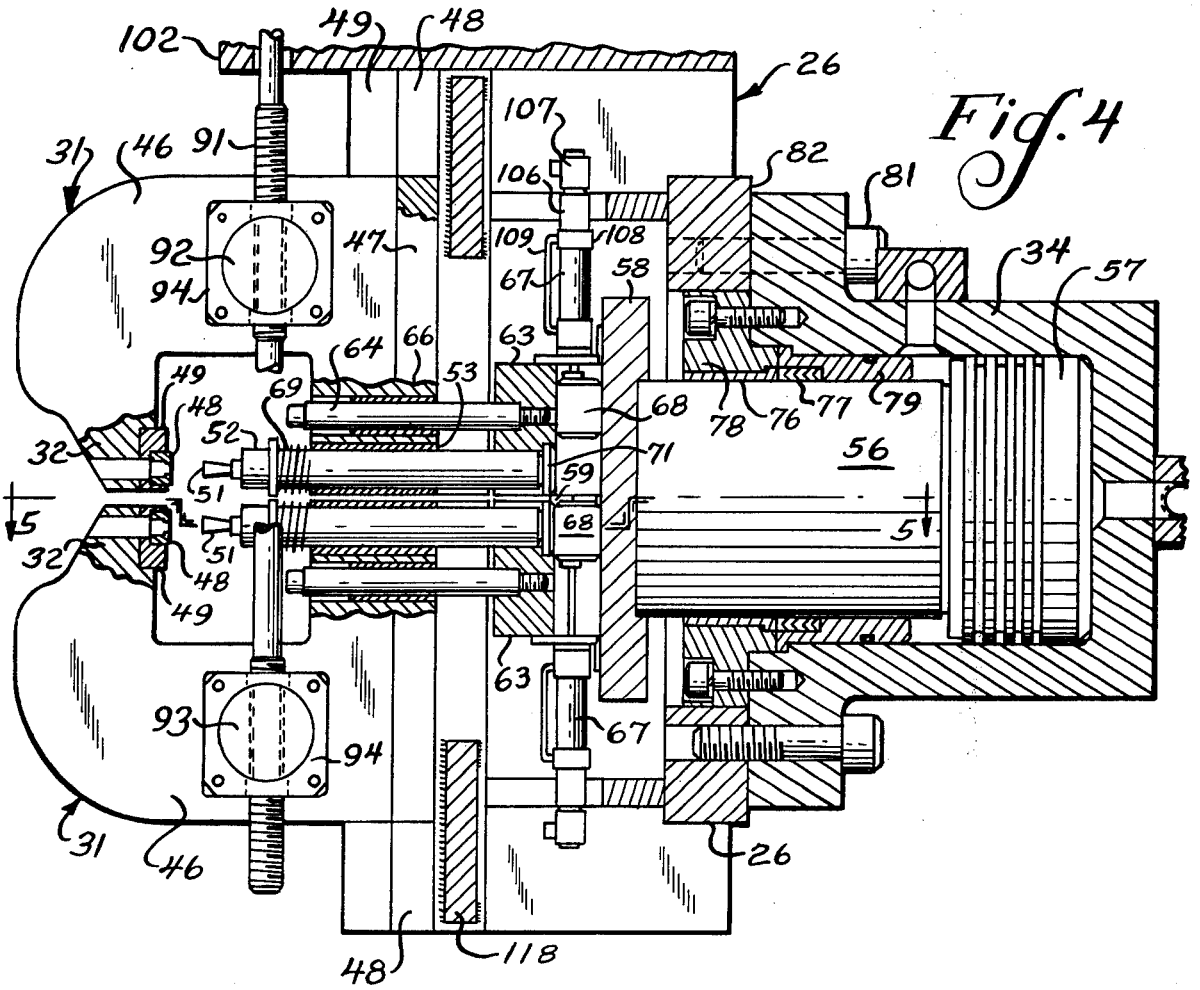
FIG. 4 is a view mainly in vertical section on the line 4—4 of FIG. 5, or partly broken away to that section, showing on a larger scale the hydraulic cylinder and punch heads and associated parts of one two-punch flange press.

Details of the flange punch press 21 are best seen in FIGS. 4 and 5. Each punch assembly 31 includes a C-shaped block 46, T-shaped in top view as seen in FIG. 5 to provide flanges 47 which ride in keyways 48 in upright guides 49. Guides 49 are welded to other parts of the frame 26. The die tip portion 32 of each C-shaped block 46 is conventionally fitted with a hardened die 48 retained by a replaceable die seat 49. Cooperating with each die 48 is a hardened punch 51. Each punch is a replaceable tool carried by a punch stem or plunger 52 which slides in the block 46, or more specifically in a bearing block 53, embedded in the block 46 and secured to it by screws 54 seen in FIG. 5. These screws are countersunk to allow the two punch assemblies 31 to move close together.

As previously indicated, both plungers 51 may be actuated by cylinder 34. Cylinder 34 is fitted with a piston comprising piston rod 56 and piston head 57. The piston rod carries a bolster 58. It will be observed that bolster 58 does not move up and down, although block 56 and hence punch plunger 52 are adjustable up and down, depending on the location desired for the hole to be punched. Accordingly, the parts moving with the punch plunger 52 must have a sliding engagement with the bolster 58. This sliding engagement is provided as seen in FIG. 5. Thus face plates 59 and spacer bar 61 (secured to bolster 58 and piston rod 56 by screws 62) provide a slideway for holder blocks 63. The up and down movement of each holder block 63 jointly with its associated "C" block 46 is ensured by a guide pin 64 firmly mounted on holder block 63, as seen in FIG. 4, and sliding through a bearing sleeve 66 in "C" block 46.

Carried by each holder block 63, to slide up and down with it is a double-acting air cylinder 67, the piston of which slides a "gag" or block 68 between the idle position shown for the upper block 68 in FIG. 4 and the effectuating or active position shown for the lower block 68 in FIG. 4. When the gag 68 is in the idle position, the thrust of piston rod 56 does not actuate punch plunger 52 to effectuate punching, because the punch plunger 52 is free to lag back while the remainder of the punching structure moves to the left. When, however, the gag 68 is moved by air cylinder 67 into its effectuating position, it transmits the thrust from bolster 58 directly to punch plunger 52 and effectuates the punching. Springs 69 ensure clearance for movement of the gag 68 into active position when piston rod 56 and parts 58 and 63 carried by it have been retracted. Thus with the punch in the position shown in FIG. 4, the spring 69 biases the plunger 52 to the left to seat plunger head 71 within the socket provided for it in block 63.

In FIG. 4, the two "C" blocks 46 are shown almost as close together as they can be. In this position, both plungers 52 are moderately close to the center line of piston 56. If one of the gags is in the idle position, the unbalanced forces developed by the active punch will not be severely unbalanced with the parts positioned as shown. However, as the "C" blocks 46 are spread apart for greater gauge spacing of the holes to be punched, the plunger 52 will move closer to the projected periphery of piston 56. It is preferred, however, that the diameter of the piston 56 be sufficient so that even with maximum separation of blocks 46, the main thrust, or at least its center line, will lie within the projected periphery of the piston, so that the twisting moments from the off-center forces, when only one gag 68 is in the effective position, will be minimal. The large diameter of piston 56 has two additional advantages. It provides a very large bearing surface between piston 56 and bushing 76, giving good durability in spite of off-center forces. Also, it makes the return speed of the piston very much faster than the speed of the working stroke. The force required on the return stroke is negligible compared to the 80 to 100 tons that must be available on the working stroke.

It may be noted that the bushing 76 serves to hold in place the packing 77 which is preferably of chevron type. The bushing 76 is carried by gland ring 78, which is secured to the cylinder 34 by screws. Gland ring 78 also holds in place stop tube 79 which limits the movement of the piston head 57. An O-ring seal prevents leakage between stop tube 79 and cylinder 34. Cylinder 34, with gland ring 78 and the parts retained by it, may be removed for servicing by removing screws 81 which secure the cylinder assembly to backplate 82 of frame 26. Of course, screws 62 seen in FIG. 5 should be removed to permit this removal of the cylinder assembly.

ADJUSTMENT FEATURES

The adjustment for the width of web 12 by moving flange press 22 away from flange press 21 may be explained in connection with FIG. 3. A motor 86 turns screw 87 in either direction to move a nut 88 to the right or left, this nut being firmly secured to the frame structure 26 of unit 22 to move this entire unit to the right or left along support rods 27. A similar drive may be provided for unit 21, although its screw 89 (FIG. 1) may be much shorter than screw 87 if one flange of the beam is always expected to be positioned approximately as shown for the flange 14 in FIG. 3. Both of screws 87 and 89 are indicated in FIG. 1, and each preferably lies directly under the center of the punch head 31 which it controls, for the greatest preciseness of positioning.

As seen in FIG. 4, the two "C" blocks 46 may be moved apart or toward one another by turning gauge screw 91, the central portion of which has been broken away in FIG. 4 for visibility of other parts. This screw 91 has threaded engagement with nut 92 carried by the upper block 46 and with nut 43 carried by the lower block 46. In one nut the threads are right hand and in the other nut left hand, so that turning screw 91 will move the nuts 92 and 93, and their associated parts, in opposite directions. Each of nuts 92 and 93 is self aligning because swiveled in a collar 94 secured to its associated "C" block 46.

As previously mentioned, the adjustment is made by motor 36, seen in FIG. 3. It drives screw 91 through suitable speed reduction gearing preferably with worm gearing so that any adjustment is self locking.

Figure 6:
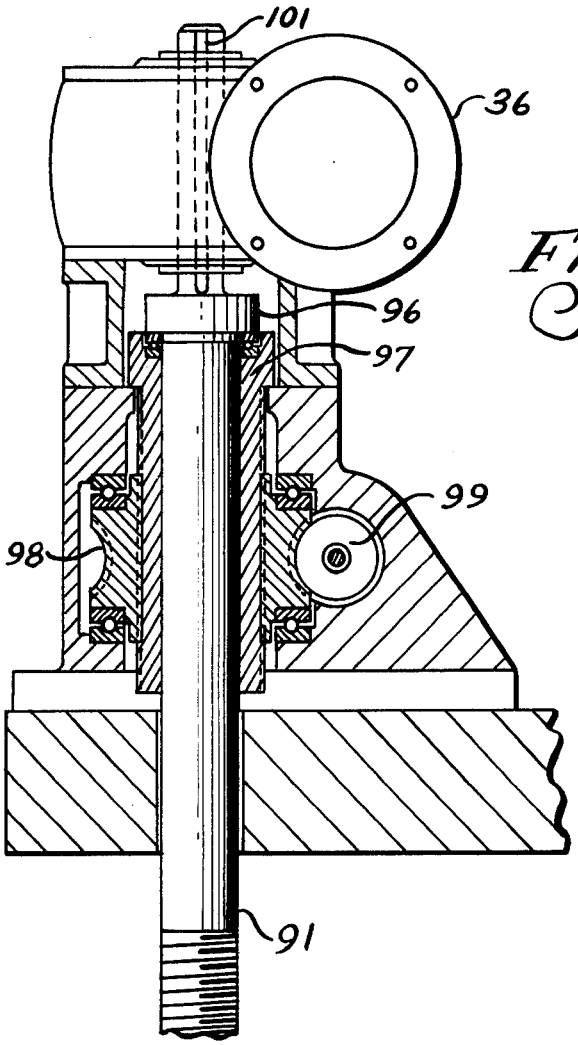
FIG. 6 is a view mainly in vertical section showing the means for turning the adjustment screw for gauge adjustment between the two heads and for raising and lowering the screw for height adjustment of the two heads considered jointly.

To adjust the height on which blocks 46 are centered, without changing the gauge adjustment of these blocks, the screw 91 seen in FIG. 4 may be raised and lowered micrometrically; i.e., with a device which, like a screw, gives progressively micrometrically fine adjustment. This can be accomplished as seen in FIG. 6. Thus the screw 91 is provided with a fixed collar or flange 96, which is supported (through a ballbearing ring) by sleeve 97. The sleeve 97 extends through, and has threaded engagement with, worm gear 98, which rests on ball bearings and is turned by worm 99. When worm 99 turns worm gear 98, the threaded engagement between worm gear 98 and sleeve 97 causes the sleeve 97 to be raised or lowered, thereby raising or lowering the screw 91. The screw 91 has sliding engagement with its driving worm gear by a spline 101 which gives it freedom of vertical movement.

Although worm 99 may be motor driven, this is not essential because the vertical shifting of screw 91 will be only slight and rare. This adjustment only needs to be made when a beam to be punched has a different web thickness than the previous beam, so that its center has a different height above positioning block 42. Infinitesimal inaccuracy in this web centering adjustment or infinitesimal variation of web thickness will not introduce even an infinitesimal error in the gauge spacing, because the rotational position of screw 91 determines gauge, and it remains locked by its worm drive from any turning.

FURTHER DETAILS

Although screw 91 has been shown in FIGS. 4 and 5 on the viewer's side of "C" blocks 46, this is for illustrative convenience. Actually, they are on the remote side of "C" blocks 46 to extend up through the long side of top plate 102, as viewed in FIG. 2. Top plate 102 is bolted to the uprights of frame 26.

Each of the air cylinders 67 is preferably controlled by valve 106 actuated by a solenoid 107. The valve 106 in one position directs the air to the near end of cylinder 67 through a passage directly through fitting 108, but not shown; and in the other position directs the air through tube 109 to the other end of cylinder 67.

One or both of nuts 88 may be associated with its respective frame 26 through a lost-motion device with a preloaded spring so as to yield if forced to do so by the passage of any slight irregularity of beam 11 past die 48. Each die 48 should be in contact with the flange when the punch strikes the flange.

The construction of frame 26 is of course subject to wide variation, and the illustrated form is probably more rugged than required, although of course a very rugged frame should be provided. The back plate 82 is welded to uprights 116, the three being in dependable squareness by virtue of U-shaped brace plates 117. Vertical guides 49 are welded to uprights 116, and preferably also to upper and lower horizontal bars 118. External braces 119 may also be provided. The entire structure must be rugged enough to transmit the punching force from the dies 48 to cylinder 34. To this end, "C" blocks 46 must be very sturdy. Hence, partly to make their dimensions appropriate for beams with narrow webs, these "C" blocks may be, for example, forged of 4140 steel and heat-treated.

Depending on purchaser preference, all adjustment drive motors may be of the stepping type so that by computer control or the like they may be driven a predetermined number of steps to position their respectively adjusted parts to precisely predetermined positions. This would be especially desirable with respect to the gauging adjustment motor 36 so that in punching the flanges of one beam, adjustments may rapidly be made for punching holes with different gauge spacing. The computer or other automatic control would also accurately control the longitudinal position of beam 11.

ACHIEVEMENT

From the foregoing it is apparent that a thoroughly practical and very versatile press apparatus has been provided for punching both webs and flanges of a beam during a single pass through the apparatus. Precise gauge accuracy is easily and dependably achieved by direct adjustment of the spacing apart of punch assemblies of one flange press by a self-locking screw adjustment means. With prior apparatus for punching both web and flanges during a single pass of the beam, attaining the required accuracy presented some difficulties, and from a practical standpoint there were rather annoying limitations on the sizes of beams which the equipment was adapted to handle.

INTENT CLAUSE

Although the above disclosure offered for public dissemination is detailed to ensure adequacy and aid understanding, this is not intended to prejudice that purpose of a patent which is to cover each new inventive concept therein no matter how others may later disguise it by variations in form or additions or further improvements. The claims at the end hereof are intended as the chief aid toward this purpose, as it is these that meet the requirement of pointing out the parts, improvements, or combinations in which the inventive concepts are found.

CLAIM LANGUAGE

In the following claims the terms "beam", "web" and "flange" are used to make the claims understandable. Any rigid structural or steel member should, if context permits, be deemed within the term "beam". Any two legs thereof at an angle to one another with its apex extending longitudinally should, if context permits, be deemed "web" and "flange".

We claim:

1. A press for punching a flange of a beam extending therethrough, including a pair of punch assemblies aligned transversely of a beam flange; each assembly including a die portion and a movable punch, and a sturdy C-frame adapted for the passage of a beam flange therethrough, and carrying the die in one end-leg thereof; cylinder-and-piston means for actuating the punches; each C-frame being of self-sufficient strength for withstanding the thrust of the punch in punching a hole through the flange of a structural steel beam; and each C-frame guiding the punch through its other end-leg and having an interlock of similar sturdiness for withstanding punch thrust transmitted to the interlock through the center-leg of the C-frame, slidable with respect to the cylinder-and-piston means for movement in a direction transverse of the beam flange; and means for moving the assemblies simultaneously toward and simultaneously from one another in said direction.

2. Apparatus for punching both flanges of an I-beam on one pass through the apparatus, including a pair of presses each according to claim 1, at least one of which is shiftable transversely of the beam to accommodate different beam web sizes.

3. Apparatus for punching both flanges of an I-beam in one pass through the apparatus, including a pair of presses each according to claim 1, at least one of which is shiftable transversely of the beam to accommodate different beam web sizes; their C-frames being substantially adjacent to each other longitudinally of the beam.

4. Apparatus for punching both flanges and the web of a beam in a single pass through the apparatus, including a pair of presses each according to claim 1, and a web press in juxtaposition therewith.

* * * * *